United States Patent [19]

Szkaradek et al.

[11] Patent Number: 4,709,863

[45] Date of Patent: Dec. 1, 1987

[54] MEDIA MILL SCREEN ASSEMBLY

[75] Inventors: Edward J. Szkaradek, Santa Ana; John J. Corrigan, Garden Grove, both of Calif.

[73] Assignee: Morehouse Industries, Inc., Fullerton, Calif.

[21] Appl. No.: 833,854

[22] Filed: Feb. 26, 1986

Related U.S. Application Data

[63] Continuation-in-part of Ser. No. 784,865, Oct. 4, 1985, which is a continuation-in-part of Ser. No. 746,440, Jun. 21, 1985, Pat. No. 4,624,418, which is a continuation-in-part of Ser. No. 663,049, Oct. 19, 1984, Pat. No. 4,651,935, and a continuation-in-part of Ser. No. 627,918, Jul. 5, 1984, abandoned.

[51] Int. Cl.[4] ..... B02C 17/16

[52] U.S. Cl. ..... 241/69; 210/488; 241/171; 241/172

[58] Field of Search ..... 210/488–492; 241/69, 70, 72, 79, 79.2, 79.3, 153, 171, 172, 173, 174, 176

[56] References Cited

U.S. PATENT DOCUMENTS

| | | | |
|---|---|---|---|
| 2,601,521 | 6/1952 | Heftler | 210/488 |
| 2,767,851 | 10/1956 | Muller | 210/492 X |
| 3,814,334 | 6/1974 | Funk | 241/70 |

FOREIGN PATENT DOCUMENTS

| | | | |
|---|---|---|---|
| 1163580 | 9/1958 | France | 210/488 |
| 7602527 | 9/1977 | Netherlands | 210/488 |
| 95799 | 5/1939 | Sweden | 210/488 |

*Primary Examiner*—Mark Rosenbaum

*Attorney, Agent, or Firm*—Knobbe, Martens, Olson & Bear

[57] ABSTRACT

A sandmill outlet screen is formed by a stack of rings which have projections and corresponding recesses stamped into them. The projections provide a gap between rings whereby flow passages between the rings are created. These passages permit the liquid being processed by the sandmill to flow out of the sandmill, but keep a grinding media in the mill. With the projections of one ring nested in the recesses of an adjacent ring, a small gap is provided. With the rings oriented to prevent nesting, a larger gap is provided. With the rings arranged so that the projections of adjacent rings abut each other, a still larger gap is obtained. This variable flow passage capability is further enhanced by varying the height of the projections.

11 Claims, 11 Drawing Figures

Fig. 1
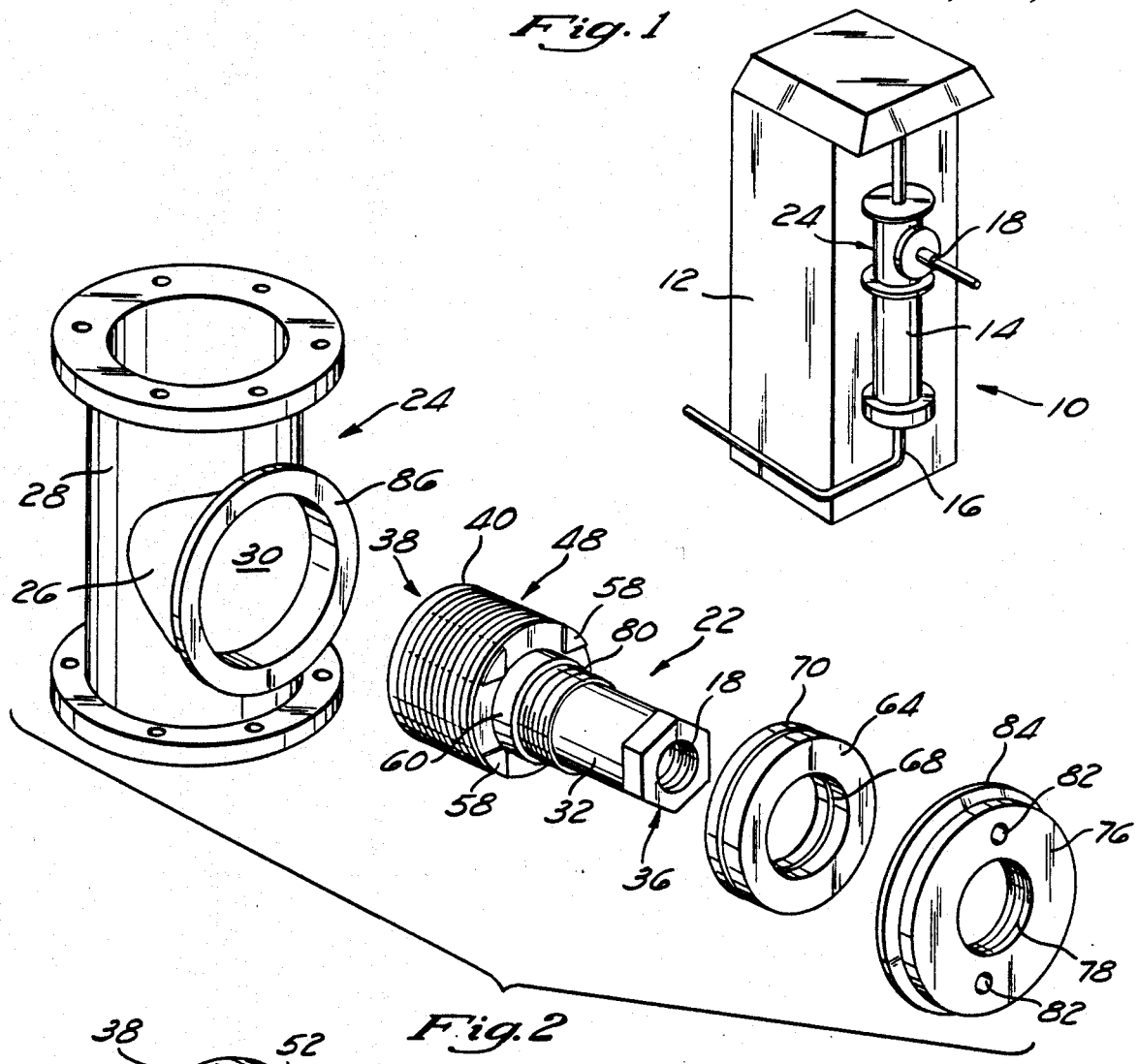
Fig. 2
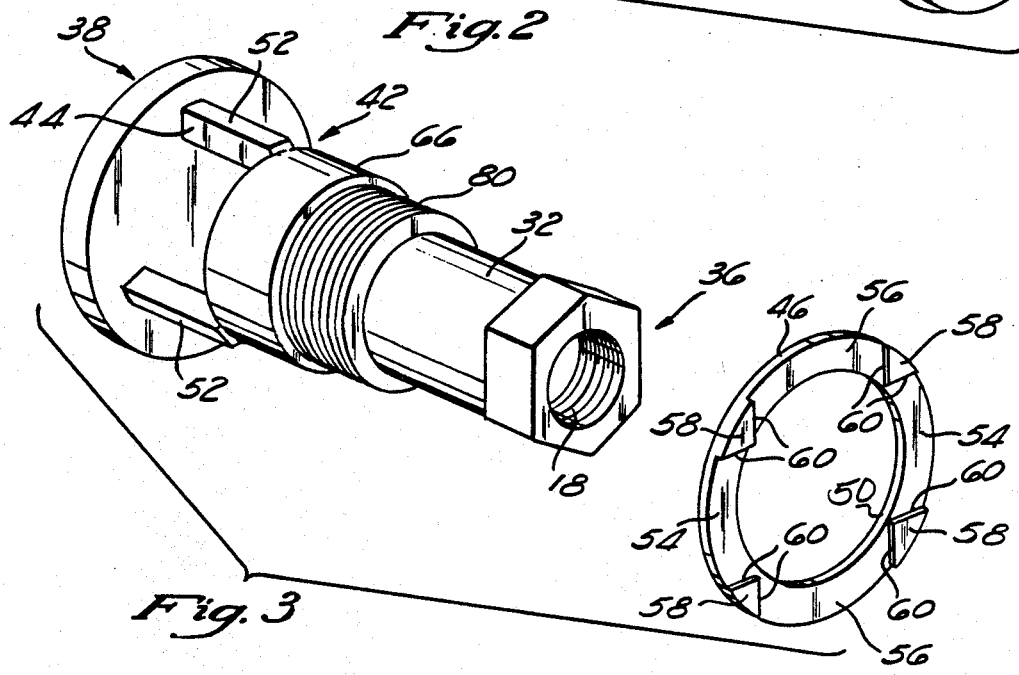
Fig. 3

Fig. 6
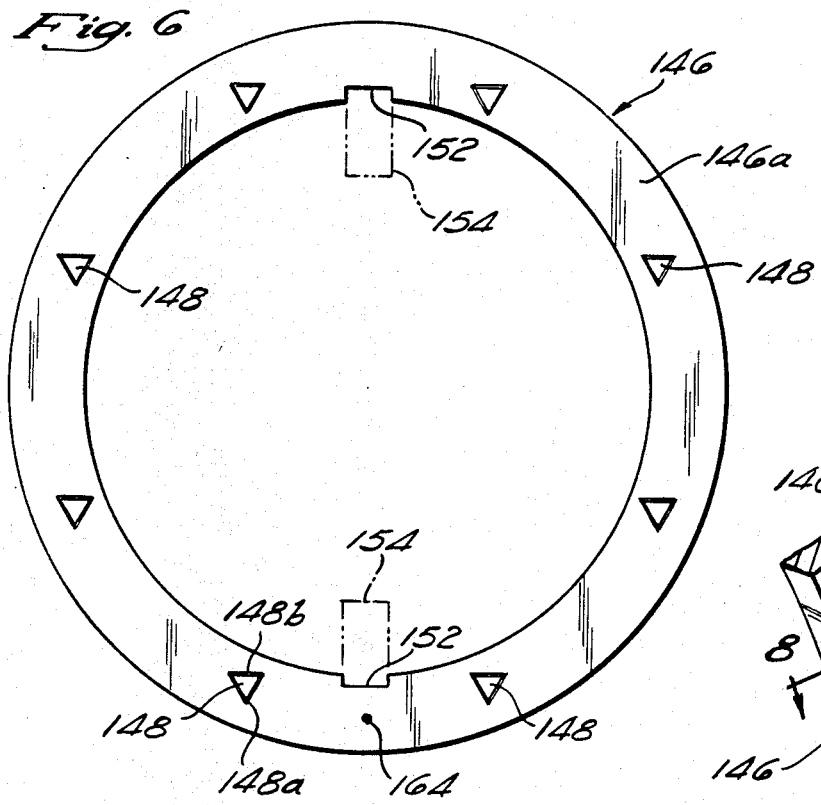
Fig. 7
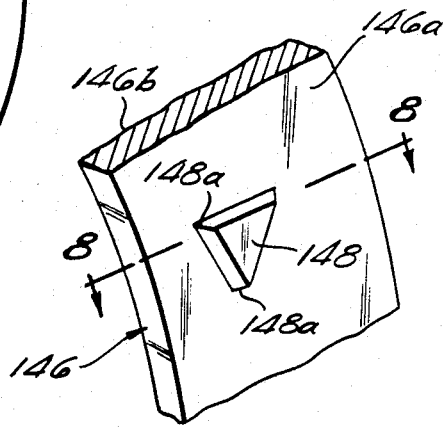
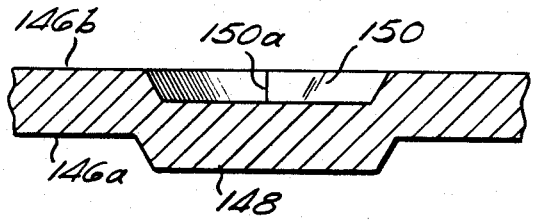
Fig. 8
Fig. 9
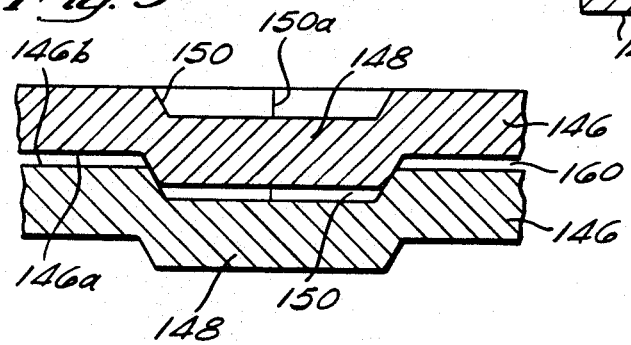
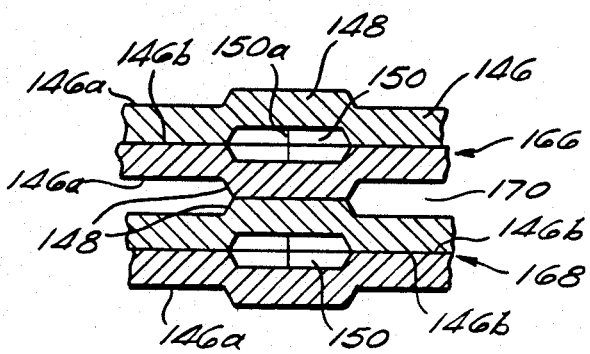
Fig. 11
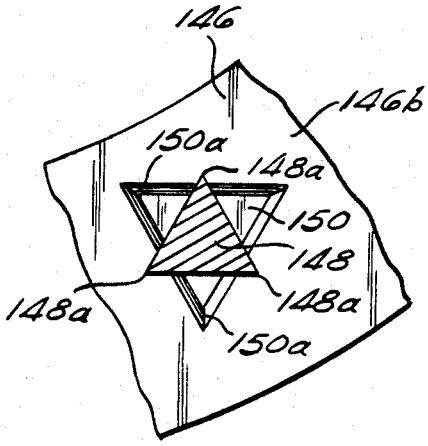
Fig. 10

MEDIA MILL SCREEN ASSEMBLY

RELATED APPLICATIONS

This application is a continuation-in-part of copending U.S. patent application Ser. No. 784,865, filed on Oct. 4, 1985, which, in turn, is a continuation-in-part of copending U.S. patent application Ser. No. 746,440, filed June 21, 1985, now U.S. Pat. No. 4,624,418, which, in turn, is a continuation-in-part of copending U.S. patent application Ser. No. 663,049, filed Oct. 19, 1984, now U.S. Pat. No. 4,651,935, and a continuation-in-part of U.S. patent application Ser. No. 627,918, filed July 5, 1984, now abandoned.

BACKGROUND OF THE INVENTION

This invention relates generally to an improved outlet screen assembly for a media mill, which is often referred to as a sand mill.

Sand milling is a proven, practical, continuous, high production method of dispersing and milling particles in liquid to produce a smooth, uniform, finely dispersed product. Some of the products for which the sand milling process is used include paints, inks, dye stuffs, paper coatings, chemicals, magnetic tape coatings, insecticides, and other materials in which milling to a high degree of fineness is required.

In a typical sand milling process, the material or slurry to be processed is introduced at one end of the processing chamber or vessel, and pumped through a small diameter grinding media while a rotor within the vessel agitates the media to mill and disperse small particles in the liquid or slurry being processed. Although the grinding media in years past was sand, currently a small manufactured product of steel, glass or other material is usually used.

The processed liquid exits from the vessel, but the grinding media must, of course, remain within the vessel. To accomplish this, the outlet structure of the mill typically includes a screen assembly which prevents media from leaving the vessel while processed liquid flows through the screen. U.S. Pat. No. 4,441,658 describes a cup-shaped assembly that leads to an outlet from the vessel. Other screen assemblies include segments forming a portion of a cylindrical wall. These screen components are typically formed of rods of small cross-section, which are welded at intersections to other small rods or struts. This in effect, creates a heavy mesh screen. A shortcoming of these welded constructions is that the screen becomes quickly worn because of the abrasive grinding media. This causes some of the strands of the screen to break or causes the openings between the strands to become large enough to allow passage of the grinding media. This requires early replacement of the screen. Also, such screen constructions are very difficult to clean, which often results in early replacement. The need for cleaning arises when a mill is unused for a period of time or when the mill is to be used for processing a different material.

The above referenced U.S. patent application Ser. No. 627,918 discloses a new and improved screen assembly for a sand mill wherein a plurality of rings or annular discs are stacked to form a cylindrical screen assembly. The rings are spared slightly to provide gaps or passages into which the liquid can flow, but the media cannot. Such a construction is much longer-wearing than the prior mesh type assemblies in that the radial thickness of the material is much greater. Also, the cross-section of the passages does not increase with wear. The ring screen is much easier to clean because the rings can be disassembled for that purpose. Further, the ring construction avoids the expensive welding process of the mesh type construction. In the arrangement shown in application Ser. No. 627,918, radially extending grooves or recesses are formed in the faces of the flat rings to provide the flow passages through the stack. The rings are illustrated as being held in the stack by a plurality of bolts extending through the rings.

The aforementioned U.S. application Ser. No. 746,440 discloses an improved arrangement wherein the spacing between rings is provided by four spaced pads on the face of the ring so that large radially extending slots or passges are formed between the pads. Also, the radial disc dimension of the rings is decreased in that bolts are no longer utilized for clamping the rings into a stack. Instead the discs are positioned by surrounding ribs and clamped as a group by an end plate. This application also discloses the screen assembly surrounding the downstream end of a horizontally oriented rotor. Such an arrangement is possible with the stack of rings because of the capability of the rings to withstand the abrasive wear of the grinding media, while still maintaining the same flow passage area.

In application Ser. No. 784,865, the ring-shaped screen elements are stacked on an internal ribbed carrier, which results in an assembly that is readily installed and removed as a unit from the outlet of a sand mill vessel. Another advantage of this approach and the others mentioned above, is that different stacks of rings providing different size flow passage, can be utilized on the same carrier.

While the foregoing described stacked ring screen assemblies, all provide significant advantages over the mesh type screen, a need still exists for improving the cost of manufacture of the rings. Also, improvements in the versatility in use of such screen assemblies is always desirable.

SUMMARY OF THE INVENTION

In accordance with the invention, flat ring-shaped elements having the desired inside and outside diameters are stamped or cut directly from a sheet of metal having the desired ring thickness. The ring is also punched at spaced intervals to form a series of recesses on one axial face of the ring and a series of projections on the other face of the ring. The projections are punched into suitably shaped female dies so that the shape and height of each of the projections is uniform. Suitable indexing slots or other structure for mounting and indexing the size is also punched or cut in each ring. Preferably, all of the punching and cutting functions are performed in a single operation utilizing a compound die.

The completed rings provide unique versatility in that they can be utilized in three different ways to provide three different screen assemblies, each having a different spacing between the rings. In one approach the rings are arranged so that the projections of one ring nest in the recesses of an adjacent ring. This provides a gap between the rings which is less then the axial height of the projection.

In a second arrangement, the projections and recesses are formed with a shape that has an orientation to it such that if adjacent rings are rotated 180° with respect to each other, the projections will not nest in the recesses of an adjacent ring. For example, triangular shaped recesses and projections will not nest with such alternate orientation in that the corners of the triangles will not be aligned. This approach provides a gap about equal to the height of a projection. The edge mounting notches provide ease of orienting adjacent rings to obtain 180° alternate orientation. However, an additional indexing mark can also be provided. This approach also ensures that the centers of the triangles are aligned so that the projections are aligned even though they do not nest in the adjacent recesses. Thus, the axial clamping force on the rings is uniformly distributed through the rings.

In a third arrangement, a pair of rings are arranged with their recessed faces engaging each other and with projections therefor extending outwardly from the two outer faces of the rings. These projections engage the projections of adjacent pairs of rings arranged with their recessed faces engaging. The result of this is that the engaging projections provide a gap between the rings which is equal to the combined height of the engaging projections.

Thus, with a single set of rings each made in an efficient one step operation, three different spacing arrangements can be obtained. This is advantageous for a user that utilizes grinding media of different sizes, since the screen passages must always be smaller than the media to prevent the media from passing out of the sand mill. As an example, in some operations, the particles being reduced in size by the milling operation may have to be first processed through a sand mill with relatively large media, which preferably should have a screen assembly with relatively large openings therethrough; and it may then be necessary to process the same liquid through a mill having media of smaller size and having a screen with smaller sized openings. Further, the height of the projections and depth of the recesses can be altered during the manufacturing operation to tailor the screen openings to best fit the particular product applications. Further, the projections can be later reduced in height by grinding, to vary the flow passage area.

BRIEF DESCRIPTION OF THE DRAWINGS

FIG. 1 is a perspective view of a media mill which can incorporate the present invention;

FIG. 2 is an exploded, perspective view of the outlet structure of a media mill and a screen assembly according to the present invention;

FIG. 3 is a perspective view of the carrier element and a single screen element of the type first set forth in the above referenced application Ser. No. 784,865;

FIG. 6 is a plan view of the improved screen element of the present invention.

FIG. 7 is an enlarged perspective view of a portion of the ring of FIG. 6;

FIG. 8 is an enlarged cross-sectional view, taken on line 8—8 of FIG. 7, illustrating the projection and recess formed in the ring of FIG. 6;

FIG. 9 is a cross-sectional view illustrating a pair of the rings of FIG. 6 nested to provide a minimum gap between the rings;

FIG. 10 is a view illustrating the alignment of the projections of adjacent rings without nesting so as to create a gap between rings equal to the height of the projection;

FIG. 11 is a cross-sectional view illustrating four of the rings of FIG. 6 arranged in a fashion to provide a gap between adjacent rings of the screen assembly that is about equal to the combined height of engaging projections.

DETAILED DESCRIPTION OF THE EMBODIMENT OF FIGS. 1-5

Figure 4:
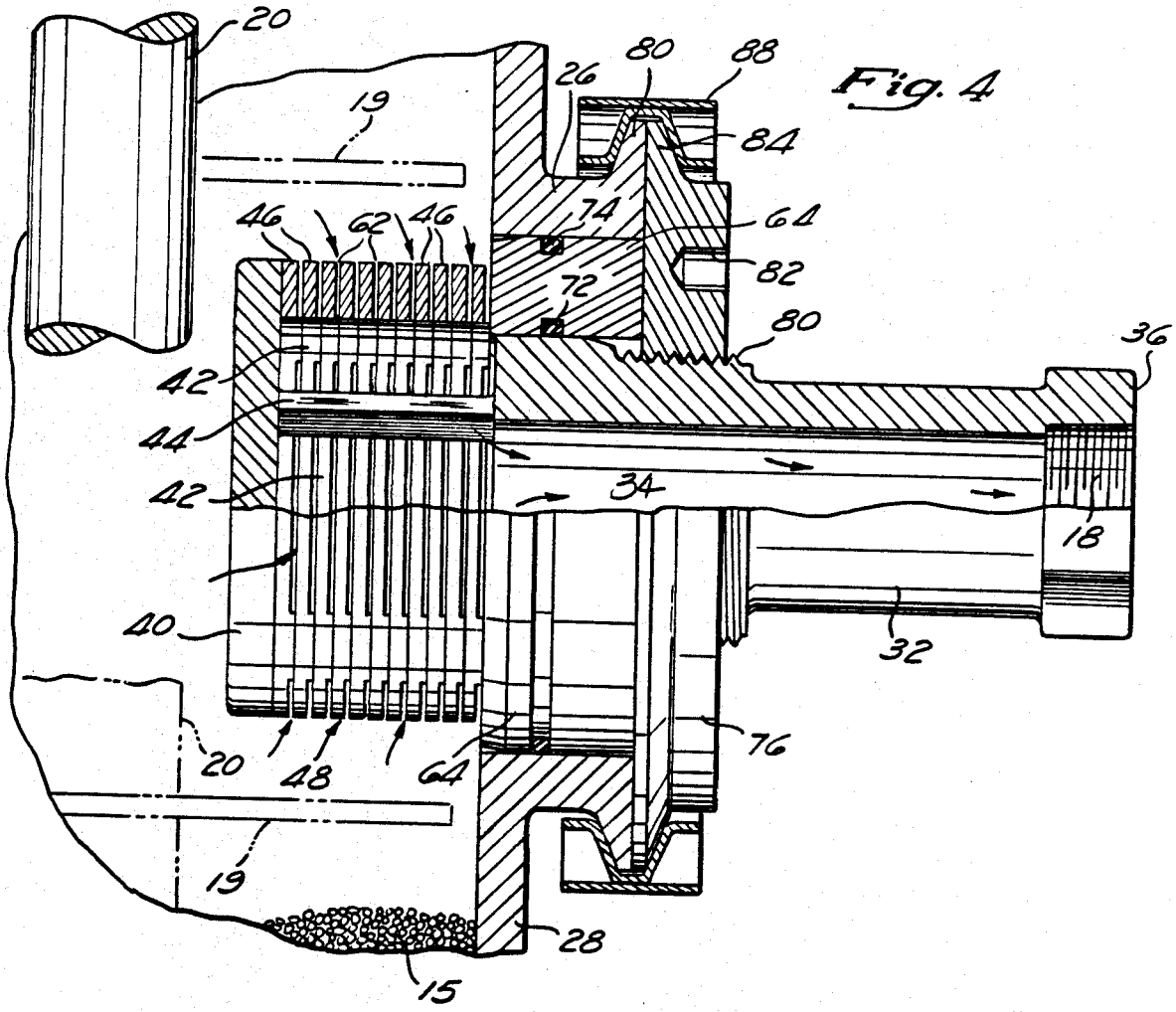
FIG. 4 is a cross-sectional view of the screen assembly as installed in the outlet structure shown in FIG. 2.

Referring to FIG. 1, a media mill 10 is shown mounted on a support housing 12. The mill includes a substantially cylindrical, vertically oriented vessel 14 having an inlet 16 at its bottom end and an outlet 18 near its upper end. A plurality of rotors 19, schematically shown in FIG. 4, are mounted on a rotatable, vertically oriented drive shaft 20 which extends through the top of the vessel 14. The shaft 20 is driven by a motor and a system of pulleys contained in the housing 12. Also within the vessel 14 is a grinding media 15, often referred to as sand, although it is typically a manufactured grit or shot.

The liquid product to be processed by the media mill 10 flows into the inlet 16, upwardly through the vessel 14, and out through the outlet 18 by means of a pump (not shown). While the product is being pumped through the vessel 14, the shaft 20 is rotated by the drive means so that the rotors 19 agitate the grinding media 15. Particles within the product are milled or ground so that the product exiting the vessel 14 is very fine and well-mixed.

To prevent the grinding media 15 from becoming suspended in the liquid product and exiting the vessel 14 through the outlet 18, the outlet 18 is formed as part of a screen assembly 22 (shown in FIG. 2). The screen assembly 22 is removably mounted within an outlet structure 24. The outlet structure 24 is a casting which forms an upper segment of the vessel 14 and has a tubular outlet housing 26 extending radially outward from the cylindrical body 28 of the outlet structure 24. The outlet housing 26 terminates in an open end 30 to form a passage into the vessel 14 through which the screen assembly 22 is inserted, as shown in FIG. 4. The outlet structure 24 can be used to retrofit existing media mills which are not adapted for use with the present screen assembly 22, but which have a removable upper segment on the vessel, such as the media mill shown in U.S. Pat. No. 4,441,698.

The screen assembly 22 includes a tubular carrier element 32 having an interior channel 34 shown in FIG. 4. The carrier 32 has an open outlet end 36 which is open to the interior channel 34 and forms the outlet 18. The other end of the carrier 32 forms a closed end 38 which terminates in a flat, preferably circular end plate 40 which is oriented in a plane normal to the central axis of the carrier 32. Adjacent the end plate 40, one or more windows 42 extend through the carrier 32 to allow fluid communication with the interior channel 34. The windows 42 are formed by the spaces between a set of ribs 44 which are spaced around the periphery of the carrier 32. The ribs 44 extend between the end plate 40 and the remainder of the carrier 32 and are parallel to the central axis of the carrier 32. While three ribs are shown, more or less could be employed.

The screen assembly 22 further includes a plurality of ring-shaped screen elements 46 which are positioned adjacently to form a cylindrical stack 48 which defines a cylindrical inner void, which may be visualized from FIG. 4. While rings of circular shape are believed to be the most practical, it should be understood that other enclosed shapes can be utilized. The ribs 44 extend through the inner void and support the screen elements 46 so that they are all coaxial with the central axis of the carrier 32. For support, the radially inner edge 50 of each screen element 46 rests on the radially outer edges 52 of the ribs 44. One end of the stack 48 abuts against the end plate 40, which has a diameter greater than the inside diameter of the screen elements 46 to prevent the stack from sliding off the closed end 38 of the carrier 32.

As is best shown in FIG. 3, an axial face of each screen element 46 has two sets of diametrically opposed slots 54 and 56. The slots 54 and 56 are separated by integral raised pads 58. The slots 54, 56 extend directly from the outside diameter of the screen elements 46 to the inside diameter. Each slot 54 or 56 has a pair of straight edges 60 which are parallel and colinear with the edges 60 of the other slot 54 or 56 which forms the pair. The alignment of the edges 60 in each pair of slots facilitates the milling of the slots 54, 56.

Referring to FIG. 4, when the screen elements 46 are stacked, the pads 58 of each screen element 46 abut against the flat, unslotted axial face of the adjacent screen elements 56 to form narrow, radially extending openings 62. The openings 62 are sufficiently narrow so that the grinding media cannot pass between the screen elements 46.

To mount the screen assembly 22 within the outlet housing 26, an annular spacer 64 is provided. One axial face of the spacer 64 abuts against the stack 48. The spacer 64 surrounds a cylindrical gland 66 on the carrier 32 which has a diameter that is approximately equal to the inside diameter of the spacer 64. Annular grooves 68 and 70 are provided on both the inner and outer radial faces of the spacer 64. An inner O-ring 72 and an outer O-ring 74 are placed in the grooves 68 and 70, respectively. The outside diameter of the spacer 64 is approximately equal to the inside diameter of the outlet housing 26, thus the outer O-ring 74 provides a seal between the spacer 64 and the outlet housing 26. Likewise, the inner O-ring 72 forms a seal between the spacer 64 and the gland 66 on the carrier 32. Thus, the open end 30 of the outlet housing 26 is completely sealed so that any liquid exiting the vessel 14 must pass through the screen elements 46 and into the interior channel 34.

The screen assembly 22 is fastened to the outlet housing 26 by means of an annular face plate 76. The face plate 76 has internal threading 78 which mates with external threading on a threaded portion 80 of the carrier 32. The face plate 76 has diametrically opposed sockets 82 which enable the face plate 76 to be rotated by a spanner wrench (not shown). When threaded onto the carrier 32, the face plate 76 acts as a nut and clamps the stack 48 between the end plate 40 and the spacer 64, thus preventing the screen elements 46 from becoming separated and the openings 62 from becoming wider.

The face plate 76 has a peripheral flange 84 which abuts against a mating peripheral flange 86 on the open end 30 of the outlet housing 26. The face plate 76 and screen assembly 22 are secured to the outlet housing 26 by means of a circular retainer ring 88 which surrounds the mating flanges 84 and 86. The retainer ring 88 is a quick disconnect type which allows the face plate 76 to be quickly fastened or unfastened fom the outlet housing 26.

To install the screen assembly 32 within the outlet structure 24, a screen element 46 is slid over the outlet end 36 of the carrier 32 and abutted against the end plate 40. Other screen elements 46 are successively slid over the carrier 32 and abutted against each other to form the stack 48. There are enough screen elements 46 so that the stack 48 completely covers the windows 42. Alternatively, all of the screen elements 46 may be arranged in a stack 48 first and slid over the carrier 32 simultaneously.

Next, the spacer 64 is slid over the open end 36 of the carrier 32 and abutted against the end of the stack 48 so that the spacer 64 surrounds the gland 66 on the carrier 32. The face plate 76 is then threaded onto the threaded portion 80 of the carrier 32. The sockets 82 permit a spanner wrench to be used to tighten the face plate 76. The farther the face plate 76 is threaded along carrier 32, the tighter the spacer 64 is clamped between the stack 48 and the face plate 76. In turn, the stack 48 is clamped between the end plate 40 and the spacer 64, preventing the screen elements 46 from separating.

After the face plate 76 is tightly secured on the carrier 32, the closed end 38 of the carrier 32 is inserted through the open end 30 of the outlet housing 26. The carrier 32 is fed into the outlet housing 26 and until the face plate 76 abuts against the open end 30 of the outlet housing 26 with the face plate flange 84 and the outlet housing flange 86 mating. To retain the carrier 32 in that position, the retainer ring 88 is clamped around the flanges 84 and 86, as is shown in FIG. 4.

To remove the screen assembly 22 from the outlet housing 26 for cleaning or replacement, the above steps are reversed. The screen elements 46 are easily removed from the outlet housing 26 since they are remain together in a stacked formation along the carrier 32, and thus do not have to be individually manipulated. The assembly 22 is easy to handle by gripping the outlet end 36 of the carrier 32.

In operation, liquid product is pumped through the vessel 14 and passes through the openings 62. The grinding media is prevented from entering the openings 62 because the openings 62 are too narrow. After passing through the screen elements 46, the liquid flows through the window 42 into the interior channel 34, and exits through the outlet 18, as shown by the arrows in FIG. 4.

The spacer 64 is long enough so that when the screen assembly 22 is fully installed, the stack 48 extends beyond the outlet housing 26 and into the vessel 14. However, the stack 48 does not extend far enough into the vessel 14 to interfere with the operation of the shaft 20. The positioning of the stack 48 within the vessel 14 allows the majority of the openings 62 to be exposed directly to the flow of liquid through the vessel 14. As a result, little pressure build up results across the screen elements 46. In contrast, if the stack 48 were entirely surrounded by the outlet housing 26, some grinding media may collect between the outlet housing 26 and the stack 48. Further, the straight edges 60 of the slots 54, 56 create direct flow paths through the screen elements 46, which help to minimize the pressure drop across the screen elements 46.

Since the stack 48 is positioned within the vessel 14, the screen elements 46 are subject to more wear by the abrasive grinding media. However, due to the depth of the openings 62, as the exterior surface of the screen elements 46 are worn down, the openings 62 do not become any wider and will not allow individual particles of media to either become lodged within an opening 62 or pass through an opening 62.

Media of different sizes may be employed for different milling operations. Consequently, screen elements that provide larger or smaller openings 62 may be utilized. It is an easy matter to withdraw the screen assembly and replace the elements with a different set.

Figure 5:
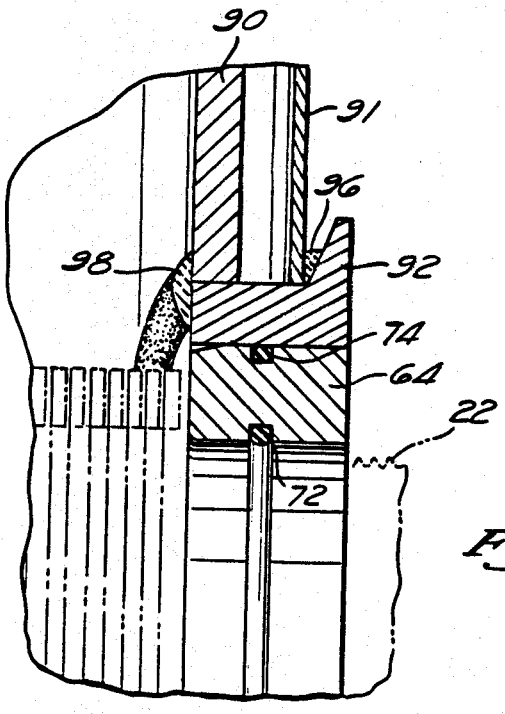
FIG. 5 is a cross-sectional view of an alternative embodiment of a vessel with the carrier and screen elements of the screen assembly shown in broken lines, such embodiments also being shown in application Ser. No. 784,865.

Referring to FIG. 5, an alternative embodiment of the invention is shown. As opposed to the outlet structure 24 shown in FIG. 2 which is separate from the remainder of the vessel 14, FIG. 5 shows a one piece vessel 90 and surrounding water gasket 91 having an outlet housing 92 which is welded to an opening through the jacket 91 and the vessel 90 along exterior and interior beads 96 and 98, respectively. The spacer 64 and screen assembly 22 (shown in broken lines) are installed in the same manner as described above. Of course, other arrangements may be provided for threading the face plate onto the carrier.

EMBODIMENT OF FIGS. 6–11

Referring now to FIGS. 6, 7, and 8, there is shown a preferred form of the screen elements or rings. The ring 146 has a plurality of projections 148 axially extending from one face **146*a* of the ring. The opposite face 146*b* of the ring has a corresponding series of recesses 150. The projections and the recesses are illustrated as having a triangular shape, but other shapes may be utilized. The projections are all oriented in the same manner with respect to the plane of the ring. That is, as viewed in FIG. 6, a point or corner 148 of each of the triangular projections 148 extends or points downwardly while the opposite side 148*b* extends horizontally. This means that the triangles are not uniformly oriented with respect to the center of the ring 146**. That is, the same portion of each triangle does not point toward the center of the ring. This means that the rings, when stacked, must be properly oriented if the projections of adjacent discs are to be similarly oriented.

In this connection, the ring is formed with a pair of diametrically opposed slots 152 in its inner diameter. A pair of ribs 154 are shown in phantom lines extending into these slots to illustrate the manner in which the rings are mounted and oriented. These ribs 154 correspond to the three ribs 44 shown in FIG. 3. More than two ribs may be employed, but it has been found that two are adequate, and utilizing only two, simplifies changing the rotational orientation of the rings.

The rings are preferably made in a single stamping or cutting operation utilizing a compound die. That is, a sheet of metal of the desired thickness is punched or cut by a die to provide a ring having the desired inner and outer diameter. Simultaneously, the two slots 152 are cut and the eight projections and recesses are formed as illustrated. The walls of the projections recesses are tapered to facilitate entry and withdrawl of punches during the cutting or stamping operation.

The rings 146 may be stacked in a manner similar to the rings in FIG. 2; however, the rings 146 may be oriented in three different arrangements to provide three different sized gaps for the screen assembly. Referring to FIG. 9, there is shown therein a portion of two adjacent rings stacked in a manner with each ring oriented, rotationally and face-to-face, in the same manner on the ribs 154. Consequently, the projections 148 on the face **146*a* of one ring nest in the recesses 150 of the face 146*b* of the adjacent ring. Because the projections are so nested, the gap 160 between the adjacent rings is less than the height of the projections 148**. The degree of nesting will depend on the taper angles of the projection and the recesses. With the depth of a recess about the same as the height of a projection, the width of the projection tip is larger than the width of the bottom of the recess to prevent complete nesting and to ensure a gap. That is, the walls of a projection and the walls of a recess interfere. Of course the projection tip must be smaller than the entry to the recess to ensure nesting.

As an alternative to only dimensional control, the projection tip could have a shape that would interfere with the recess walls to obtain the desired gap. Such can be obtained with suitable dies. If the recess depth is formed less than the projection height, by the use of suitable dies, a desired gap can be obtained through interference between the top of a projection and the bottom of the recess:

In a prototype version of the screen assembly, a stainless steel ring having a thickness of 0.047 inches was formed to provide a projection of about 0.020 inches and a corresponding recess of about 0.020. With adjacent rings nested as shown in FIG. 9, a gap of 0.006 to 0.007 of an inch is created. The ring is provided with eight equally, circumferentially spaced projections, as shown in FIG. 6. Rings of various diameters may be provided, and if particularly large sizes are desired, additional projections may be wanted to insure adequate support for the relatively thin rings.

In a second arrangement, a ring 146 is rotated 180° from the adjacent ring with the projections still oriented so that the projections 148 of one ring 146 engage the recessed face **146*b* of the adjacent ring. With this 180° orientation, the triangular projections are no longer rotationally oriented, so that the corners of one projection 148 are aligned with the corners of the axially aligned recess 150 of the adjacent ring 146. This may be seen most easily from the view of FIG. 10 wherein the corners 150*a* of one recess are positioned between the corners 148*a* of an adjacent projection 148. The result of this arrangement is that the projections and recesses do not nest, and the projections hold the adjacent rings spaced from each other. The gap between rings is the height of the projection, which in the previous example is 0.020 inches. The actual gap may be slightly less than that due to the compression of the rings which occurs as the retaining nut is tightened onto the threaded support 80**.

The relative orientation of a pair of rings can be observed by merely looking at the orientation of the projections, bearing in mind that there are only two rotational positions of the rings, in view of the two ribs 154. However, to further facilitate the orientation process, each ring is preferably provided with a suitable indexing mark 164 adjacent the slots. Thus, to obtain the orientation of the rings shown in FIG. 9, it is only necessary to axially align all of the index marks 164 when stacking the rings on the ribs 154. By contrast, to arrange the orientation of the rings illustrated in FIG. 10, the indexes 164 of adjacent rings are alternately oriented 180° from each other.

FIG. 11 illustrates the third orientation of the rings wherein a pair 166 of rings 146 are positioned with their recessed faces **146*a* and 146*a* in engagement, with the projections 148 of these rings extending axially away from each other. An adjacent pair 168 of rings similarly have their recessed faces 146a engaging each other, with the result that the projections 148 of two opposing faces 146b of adjacent pairs 166 and 168 engage each other so that the gap 170 between the faces 146b of adjacent rings is equal to the combined height of the engaging projections. Since the rings are identical, the gap is twice that of the height of a projection 148. In other words, using the example mentioned above, the gap 170** between the adjacent rings having the engaging projections is about 0.040 inches minus whatever is lost due to compression.

It should be noted that with the arrangement of FIG. 11 the rings can be rotationally oriented like either of FIGS. 9 and 10, since the axial faces of the projections 148 will engage in any event. Nevertheless, it is preferable that the indexes 164 all be aligned so that the corners of the recesses in the projections will all be aligned as in the arrangement of FIG. 9 as opposed to the alternate alignment shown in FIG. 10.

With these three arrangements, a single group of rings 146 is very versatile in that the user can quickly change the gaps in the screen assembly to any of the three choices. As indicated above, this may be desirable in situations where it is necesary to process the same material more than once. In a first pass the material may be processed through a mill using a large diameter media which is necessary to obtain adequate reduction of large particles, and then process the material through the mill employing media with a smaller size. The screen assembly must, of course have flow passages which are smaller than the media, so as to prevent the media from exiting the machine with the product being processed. Utilizing a screen with passages only slightly smaller than the media can also result in clogging of media passages. Large diameter media is utilized when there are larger sized particles in the product being processed. If a screen assembly with small passages is used with a product having relatively large particles therein, the particles themselves can cause clogging of the screen assembly. Thus, the screen assembly of the invention minimizes the number of screen assemblies needed to meet the requirements of various users.

Another feature of the arrangement of FIGS. 6–11 that adds to its versatility is that the depth of the projections can be readily controlled during the stamping process to provide projections of various heights, thereby changing the gap of the three arrangements. In this fashion, the design of the screen mill assembly may be further tailored to fit the requirements of a particular user.

The screen assembly of FIGS. 6–11, of course, has all the other advntages of the assembly shown in FIGS. 2–5. That is, the screen assembly has long-wearing ability, the rings are easily cleaned, and may be individually replaced if for some unusual reason this should be necessary. By contrast, the old welded rod type screen had to be discarded or repaired by expensive welding, if a portion became damaged. The stacked ring type screen assembly is also advantageous from the standpoint of ease of assembly of a stack of rings and ease of installation and removal of the assembly into and out of the sand mill.

What is claimed is:

1. A milling apparatus comprising:

a vessel for receiving grinding media and a liquid having small particles therein which are to be milled or reduced in size within the vessel;

a motor driven rotor in said vessel for agitating the grinding media;

a liquid inlet to which said liquid is introduced as the grinding media is agitated by the rotor;

a liquid outlet in said vessel; and a screen assembly at said outlet to prevent the media from passing through said outlet while permitting the liquid to pass through said outlet, said assembly including a plurality of ring-shaped screen elements arranged in a stack, each of said elements having a plurality of projections extending from one axial face of the element and a plurality of recesses extending into its other axial face, with each projection being axially aligned with a recess, with said projections and recesses having a similarly shaped crosssection, said elements being stacked so that the projections on said elements space said elements from each other to provide a gap or passage smaller than said media whereby liquid may flow through the passage but said media may not;

said projections and recesses being sized so that the projections of one ring will partially nest into the recesses of an adjacent ring when said rings are rotatably oriented in one circumferentially indexed position with the projections on the face of one ring facing the recessed face of an adjacent ring, whereby said gap is approximately equal to the height of a projection minus the portion of the projection which extends into the recess of the adjacent ring;

said projections and recesses being formed so that when said rings are rotated to a second circumferentially indexed position wherein the projections of one ring extended toward the recessed face of the adjacent ring engage the face of said adjacent ring so that said gap is approximately equal to the height of one of said projections, and said rings having means for indexing the rings in said first and second positions.

2. The apparatus of claim 1 wherein said rings are adapted to be oriented in a third indexed position wherein each of said elements engage the recessed face of an adjacent element so that no gap is formed between those faces of those two elements but the projections on each of said elements are oriented to engage the projections of adjacent elements whereby the gap between the faces of the elements having the projections is equal to the combined height of the engaging projections.

3. A screen assembly for the outlet of a milling apparatus wherein a slurry being milled passes through grinding media being agitated by a rotor, the assembly comprising:

a plurality of flat rings, each of said rings having a plurality of projections extending outwardly from one axial face of the ring, and a plurality of recesses formed in the other axial face of each ring with the recesses being aligned with the projections; and structure for supporting said rings in a stack so that the projections will separate some of the adjacent rings to create a gap and provide passages extending between the interior and exterior of the rings, the passages being sized to prevent said grinding media from passing therethrough;

said projections and recesses being sized so that the projections of one ring will partially nest into the recesses of an adjacent ring when said rings are rotatably oriented in one circumferentially indexed position with the projections on the face of one ring facing the recessed face of an adjacent ring, whereby said gap is approximately equal to the height of a projection minus the portion of the projection which extends into the recess of the adjacent ring;

said projections and recesses being formed so that when said rings are rotated to a second circumferentially indexed position wherein the projections of one ring extending toward the recessed face of the adjacent ring engage the face of said adjacent ring so that said gap is approximately equal to the height of one of said projections; and said rings having means for indexing the rings in said first and second positions.

4. The assembly of claim 3 wherein in said second position said projections engage the sides of said recesses to create said gaps.

5. The assembly of claim 4 wherein the tip of each projection is smaller than the entry to its mating recess but larger than the bottom of the recess.

6. The assembly of claim 3 wherein in said second position said projections are rotationally aligned with the recesses of an adjacent ring, but said projections and recesses are oriented so that the projection of one ring will not nest in the recess of an adjacent ring.

7. The assembly of claim 6 wherein said rings have the same projections and recesses, but said recesses and projections are shaped such that rotating one ring a predetermined amount, will orient the projection of one ring with respect to the recess of an adjacent ring so that the projection will not nest in the recess of the adjacent ring.

8. The assembly of claim 7 wherein said projections and recesses have a triangular cross-section.

9. The assembly of claim 8 wherein in said second position said adjacent rings are oriented so that the corners of one triangular projection will intersect the sides of the adjacent triangular recess of the adjacent ring, thereby preventing the projection from nesting within the adjacent recess.

10. The assembly of claim 3 wherein said support structure includes a pair of diametrically spaced ribs and said rings are positioned over said ribs, and each of said rings includes a pair of slots on its inner diameter which fit onto the edges of said ribs so that the rings can only be mounted on said ribs in two angular orientations.

11. The assembly of claim 3 wherein said rings are adapted to be mounted in a third indexed position with a pair of rings positioned with their recessed faces in engagement, with the result that the ring faces having the projections extend axially outwardly in opposite directions so that the projections of the ring of an adjacent pair of rings with their recessed spaces in engagement will engage the projections of one ring of the first pair of rings and thereby form a gap between the two rings having their projections in engagement, said gap being equal to approximately the combined height of the engaging projections.

* * * * *